US006527320B1

(12) United States Patent
Gregg

(10) Patent No.: US 6,527,320 B1
(45) Date of Patent: Mar. 4, 2003

(54) ANIMAL DROPPINGS COLLECTOR

(75) Inventor: James J. Gregg, Mauldin, SC (US)

(73) Assignee: IDM Products, Inc., Mauldin, SC (US)

( * ) Notice: Subject to any disclaimer, the term of this patent is extended or adjusted under 35 U.S.C. 154(b) by 0 days.

(21) Appl. No.: 10/006,513

(22) Filed: Dec. 6, 2001

(51) Int. Cl.[7] ..... A01K 29/00; E01H 1/12

(52) U.S. Cl. ..... 294/1.3; 15/257.6

(58) Field of Search ..... 294/1.1, 1.3–1.5, 294/25, 26.5, 31.2, 55, 100, 103.1; 15/104.8, 257.1, 257.2, 257.6, 257.7; 81/64; 119/161, 867; 229/115, 117.09, 117.24, 117.27, 125.03, 125.12, 125.18, 125.22, 129.1, 164.2

(56) References Cited

U.S. PATENT DOCUMENTS

| | | | | | |
|---|---|---|---|---|---|
| 2,886,230 | A | * | 5/1959 | Langley | 229/125.12 X |
| 3,052,214 | A | * | 9/1962 | Johnson | 294/1.4 |
| 3,608,712 | A | * | 9/1971 | Savoie | 229/164.2 X |
| 3,777,708 | A | * | 12/1973 | Vogt | 294/1.5 |
| 3,830,423 | A | * | 8/1974 | Prescott | 294/1.3 |
| 3,885,266 | A | * | 5/1975 | Nafziger | 294/1.3 |
| 3,977,422 | A | * | 8/1976 | Cabaluna | 294/1.4 X |
| 4,215,888 | A | | 8/1980 | Gavin et al. | 294/1.3 |
| 4,425,731 | A | * | 1/1984 | Orlando | 229/115 X |
| 4,458,932 | A | | 7/1984 | Resch | 294/1.3 |
| 4,529,236 | A | | 7/1985 | Vogt | 294/1.3 |
| 4,830,419 | A | | 5/1989 | Watanabe | 294/1.3 |
| 5,522,284 | A | * | 6/1996 | Sade | 81/64 X |
| 5,797,636 | A | * | 8/1998 | Hamynen | 294/1.3 |
| 6,135,519 | A | | 10/2000 | Kotlinski | 294/1.3 |

FOREIGN PATENT DOCUMENTS

| | | | | |
|---|---|---|---|---|
| DE | 3225602 | | 1/1984 | 294/1.3 |
| FR | 89 12318 | | 9/1989 | |
| FR | 2686106 | * | 7/1993 | 294/1.3 |
| NL | 8702192 | | 4/1989 | |

* cited by examiner

*Primary Examiner*—Johnny D. Cherry
(74) *Attorney, Agent, or Firm*—Leatherwood Walker Todd & Mann, P.C.

(57) ABSTRACT

A device for picking up material, such as animal droppings, which includes a container defining a compartment and a slot. A flexible elongated member is provided, one end of the elongated member being fixedly attached to the container, and the other end of the elongated member being a free end. The elongated member is configured to form a loop outside of the compartment. The loop is movable between a first position, for generally surrounding the material, and a second position, wherein the loop is substantially inside of the compartment. Upon the loop being in the first position and positioned for encircling the material, the free end of the elongated member is pulled such that the loop and the material it surrounds is pulled into the compartment to the loop's second position. The device may then be disposed of in its entirety.

17 Claims, 4 Drawing Sheets

Fig. 7
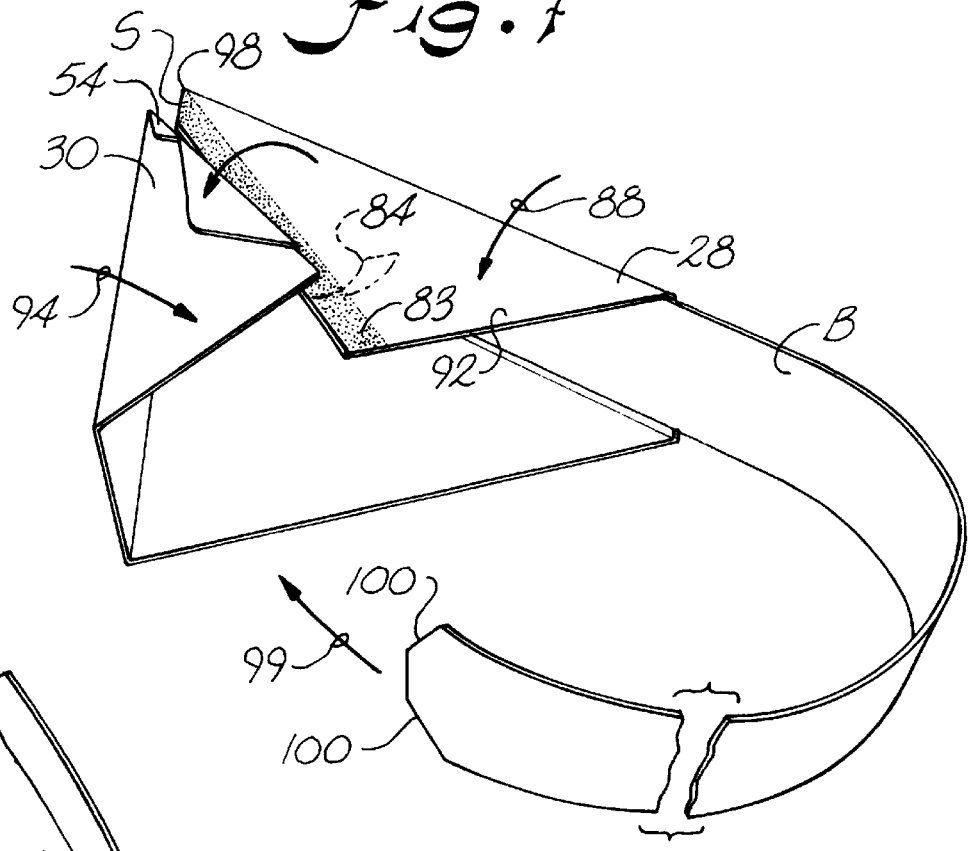
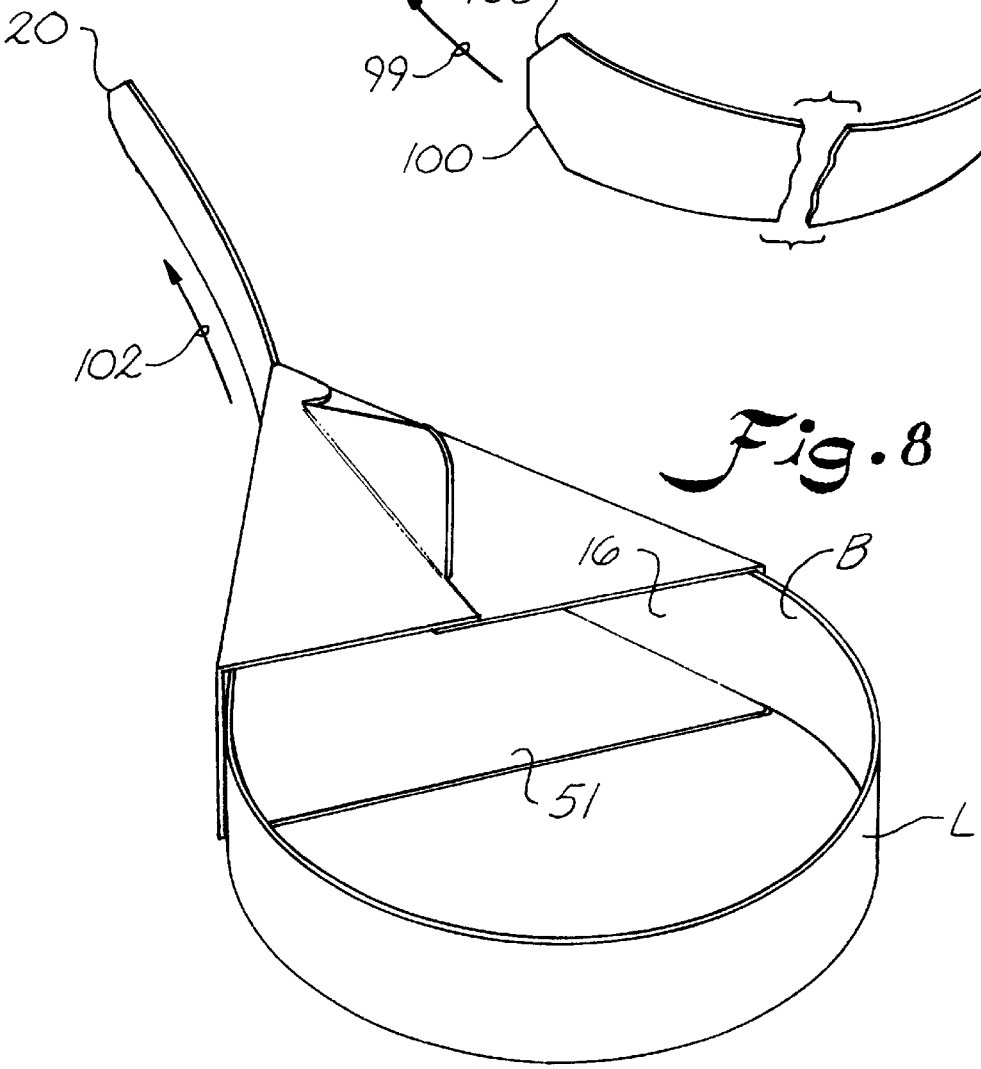
Fig. 8

ANIMAL DROPPINGS COLLECTOR

BACKGROUND OF THE INVENTION

This invention relates generally to a device for collecting material, and in particular, animal droppings, and for allowing disposal thereof in a sanitary manner.

Disposal of pet waste is a problem which has been addressed by numerous devices in the past. Scoops, scrapers, pans, and related receptacles and containers have been provided for removing and disposing of animal waste, and in particular, animal droppings. Disposal of such waste is not only desirable, but has been mandated by many communities, which have enacted regulations requiring pet owners to dispose of droppings deposited by their pets on public sidewalks, streets, parks, etc.

Various devices have been patented for collecting and disposing of pet waste. For example, U.S. Pat. No. 4,830,419, issued to Watanabe, discloses a disposable animal waste collector having a handle for collecting and enclosing waste material. An advantage of this device is that it is disposable after it has been used for collecting waste. This means that no cleaning of the device is required after use, as is the case of reusable devices such as scoops, scrapers, pans, etc.

U.S. Pat. No. 4,529,236, issued to Vogt, discloses an animal droppings pickup device having a pull cord tab used in connection with a cover member and base portion for collecting waste. With this device, the droppings are wrapped as a package within a flexible sheet of material, the package itself being removable for disposal, with replacement sheets being available for subsequent uses of the device.

U.S. Pat. No. 6,135,519, issued to Kotlinski; U.S. Pat. No. 4,458,932, issued to Resch; and U.S. Pat. No. 4,215,888, issued to Gavin, et al., each disclose other disposable waste collection devices. The Kotlinski patent is foldable and includes a box for receipt of the waste, and the Resch patent discloses use of a bag for holding the waste. The Gavin, et al. patent discloses use of a sliding tray within a sleeve.

Another common device used for collecting animal waste is an ordinary food storage bag, such as a "baggie," having a sealable flap, or preferably, a zipper-type closure means. When using such a device, the user would turn the bag inside out and, using the bag as a sort of glove or mitten, grab the waste and then invert the bag and seal it. While such a bag provides a relatively inexpensive and readily available device for use in collecting animal waste, many users are reluctant to touch and handle the waste in this manner, even though their hand is separated from the waste by the bag thickness.

While the foregoing animal waste collection devices are known, there still exists a need for a compact, disposable device which provides for effective retrieval and collection of animal waste, and the sanitary disposal thereof.

SUMMARY OF THE INVENTION

It is, therefore, the principal object of the present invention to provide an improved device and method for collecting material, such as animal droppings.

Another object of the present invention is to provide a device for collecting animal droppings, and for allowing the sanitary disposal thereof.

Another object of the present invention is to provide a device for collecting animal droppings which is compact, and is easy to transport.

Yet another object of the present is to provide a device for collecting animal droppings which is disposable.

Still a further object of the present invention is to provide a scraping action during use for an improved collection of animal droppings.

A further object of the present invention is to provide a device for collecting animal droppings which can become compactly nested with plurality of such devices for ease of transport.

More specifically, the present invention includes the elongated strap being made of a flexible material, such as plastic, and the container being triangular and constructed of a material such as paper, with the slot being at the apex of the container.

Generally, the present invention includes a device for picking up material, such as animal droppings, and includes a container defining an opening. A flexible, elongated member, is provided, one end of the elongated member being fixedly attached to the container. The elongated member is configured such it forms a loop with respect to the compartment, and the elongated member defines a free end such that upon pulling of the free end, the loop decreases in size and moves towards the compartment. The loop is movable between a first position, for generally surrounding the material, wherein the loop is substantially outside of the compartment, and a second position, wherein the loop is substantially inside of the compartment generally surrounding the material. The loop is movable from the first position to the second position by pulling on the free end of the elongated member.

More specifically, the present invention includes the elongated member being a generally flat strip made of plastic or a paper product, and wherein the container is generally triangularly shaped.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which:

FIG. 7 is a perspective view of the sheet of material having been folded along the folds thereof for forming the container; and FIG. 8 is a perspective view illustrating the container of the animal droppings collector in final form, with a free end of the strap passing through a slot in the container.

DESCRIPTION OF THE PREFERRED EMBODIMENT

Figure 1:
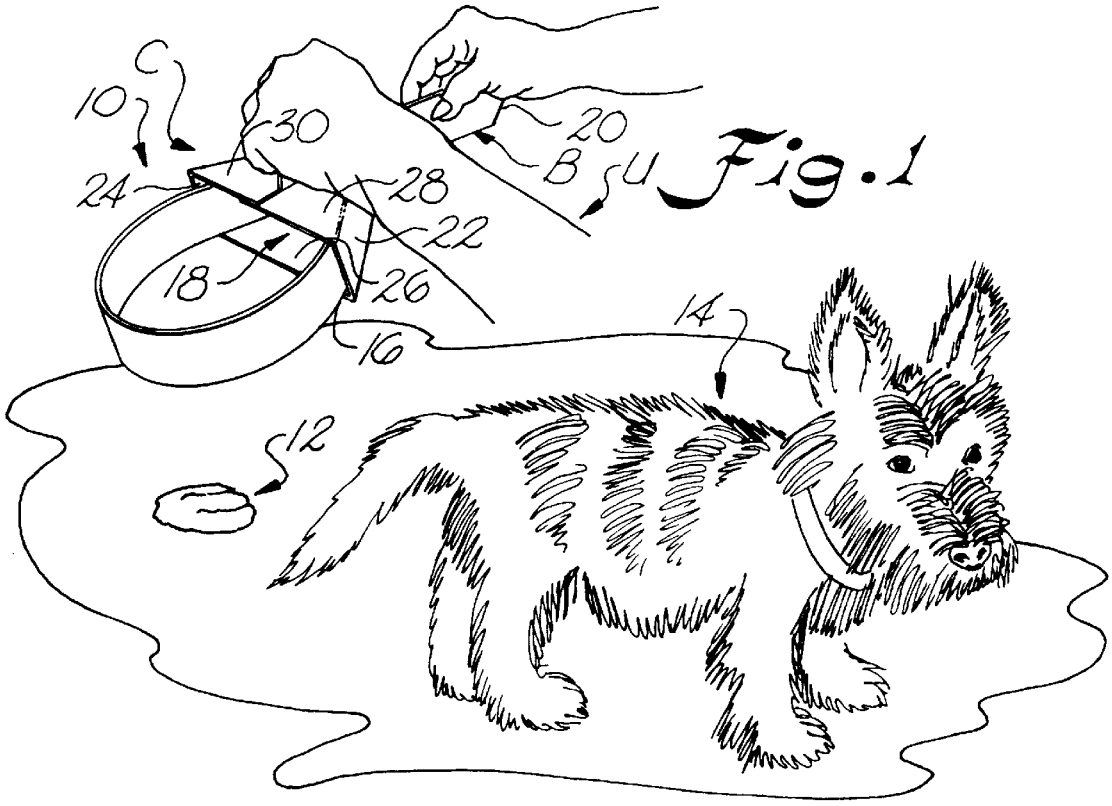
FIG. 1 is a perspective view of an animal droppings collector constructed in accordance with the present invention, and shown in use approaching animal droppings to be collected.

The accompanying drawings and the description which follows set forth this invention in its preferred embodiment. However, it is contemplated that persons generally familiar with waste disposal devices will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the animal droppings collector of the present invention is indicated generally in the figures by reference character 10.

Turning to FIG. 1 of the drawings, animal droppings collector droppings 10, generally, is shown in use for collecting and allowing subsequent disposal of animal droppings 12 of dog 14. Device 10, generally, includes a container, generally C, and an elongated member, such as a flexible strip, strap, or band, generally B. One end 16 of band B is fixably attached within a compartment 18, and the other, free end 20, of band B passes through a slot (FIG. 2), generally S, of container C. The container C, when viewed from above, in one preferred embodiment, is generally a triangular shape, having side walls 22, 24, a bottom wall, 26, and two top wall portions 28 and 30.

Figure 2:
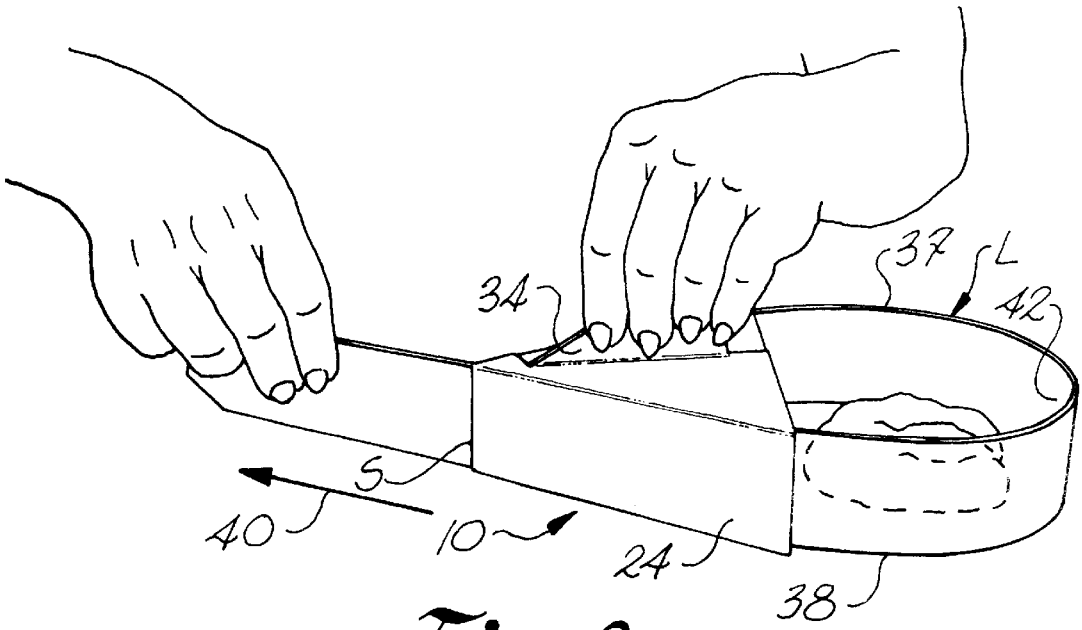
FIG. 2 is a perspective view showing use of an animal droppings collector constructed in accordance with the present invention, in use, wherein a strap or band of the device encircles animal droppings.
Figure 3:
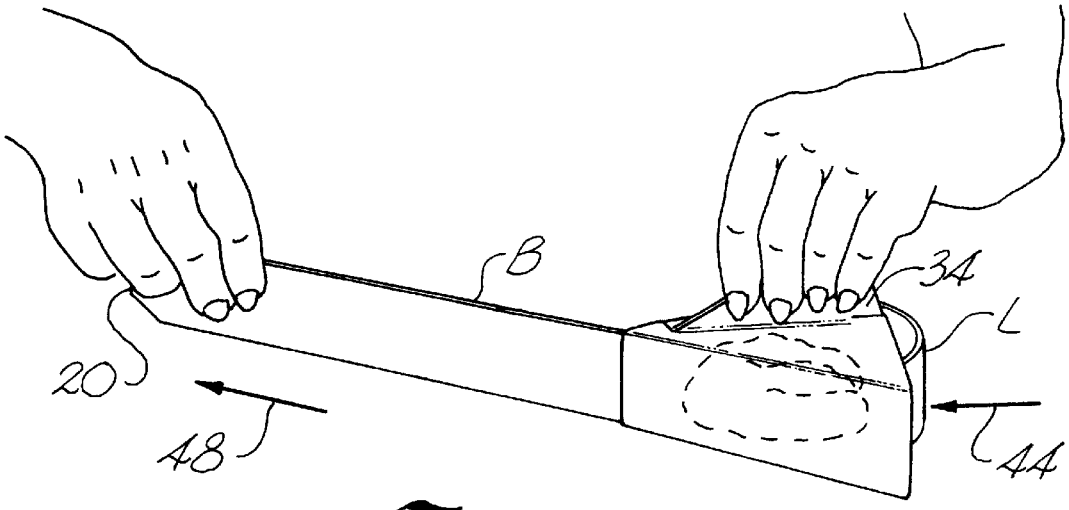
FIG. 3 is a perspective view of an animal droppings collector constructed in accordance with the present invention, wherein the animal droppings have been drawn into a compartment through pulling on the strap.

FIG. 1 illustrates a user U holding device 10 in proper form as device 10 is used to approach droppings 12. FIG. 2 illustrates the bottom of container C being placed on the surface on which droppings 12 rest. The user would hold container C by an upstanding tab 34 and would hold container C stationary, preferably pressing downwardly slightly, such that the bottom wall 26 of container C is held against the surface. The free end 20 of band B, having already been inserted through slot S, is then held by the user, the band B forming a loop, generally L. Band B includes an upper edge 37 and a lower edge 38, and the lower edge 38 of band B also preferably rests on the surface, such that as band B is pulled, in the direction of arrow 40 in FIG. 2, the lower edge 38 of band B would tend to scrape, or "squeegee" the surface. Continued pulling of free end 20 of band B causes loop L to shrink, such that loop L consequently encompasses, or "corrals" droppings 12. Further pulling of free end 20 of band B causes the inner side 42 of loop L to contact droppings 12 and to scrape droppings 12 into compartment 18, as shown in FIG. 3. The direction of movement of loop L is shown by arrow 44 in FIG. 3, the movement of loop L being brought about by continued pulling of band B in the direction as shown by arrow 48, also in FIG. 3.

Figure 4:
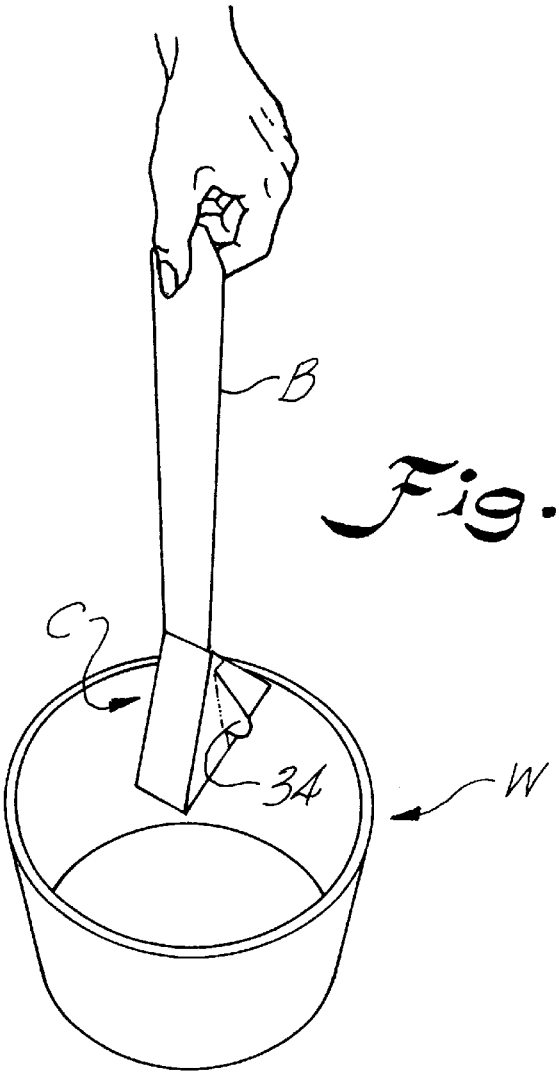
FIG. 4 is a perspective view of an animal droppings collector constructed in accordance with the present invention, wherein the device is being disposed into a waste basket after collecting animal droppings.

Band B is of a height approximately equal to the height of side walls 22, 24 of container C. Band B may be of a slightly taller height than side walls 22, 24, such that there is a slight interference fit between band B and the ceiling portions 49*a* and 49*b* of top walls 28, 30, respectively, and the floor 51 of bottom wall 26, respectively, once loop L enters compartment 18 of container C. This interference fit causes droppings 12 to be essentially sealed and contained within compartment 18 once loop L is within compartment 18. This allows for the user to hold device 10 by free end 20 of band B in order to dispose of device 10 in a waste basket, generally W, in its entirety, together with droppings 12 sealed within compartment 18, as shown in FIG. 4.

Animal droppings collection device 10 could be made in various sizes and configurations, and it is to be understood that the present invention is not limited to the generally triangular configuration disclosed herein. For example, container C, although not shown, could be of a semicircular or rectangular shape, or some curved or irregular shape, if desired. Further, device 10 could also be sold in different sizes such that compartment 18 is properly sized to accommodate droppings from a particular animal.

Container C could be formed of a variety of different materials, but in one preferred embodiment, is formed of cardboard. Similarly, band B is preferably formed of plastic, such as polystyrene, polyvinylchloride (PVC), paper stock, cardboard, or some other suitable material.

Figure 5:
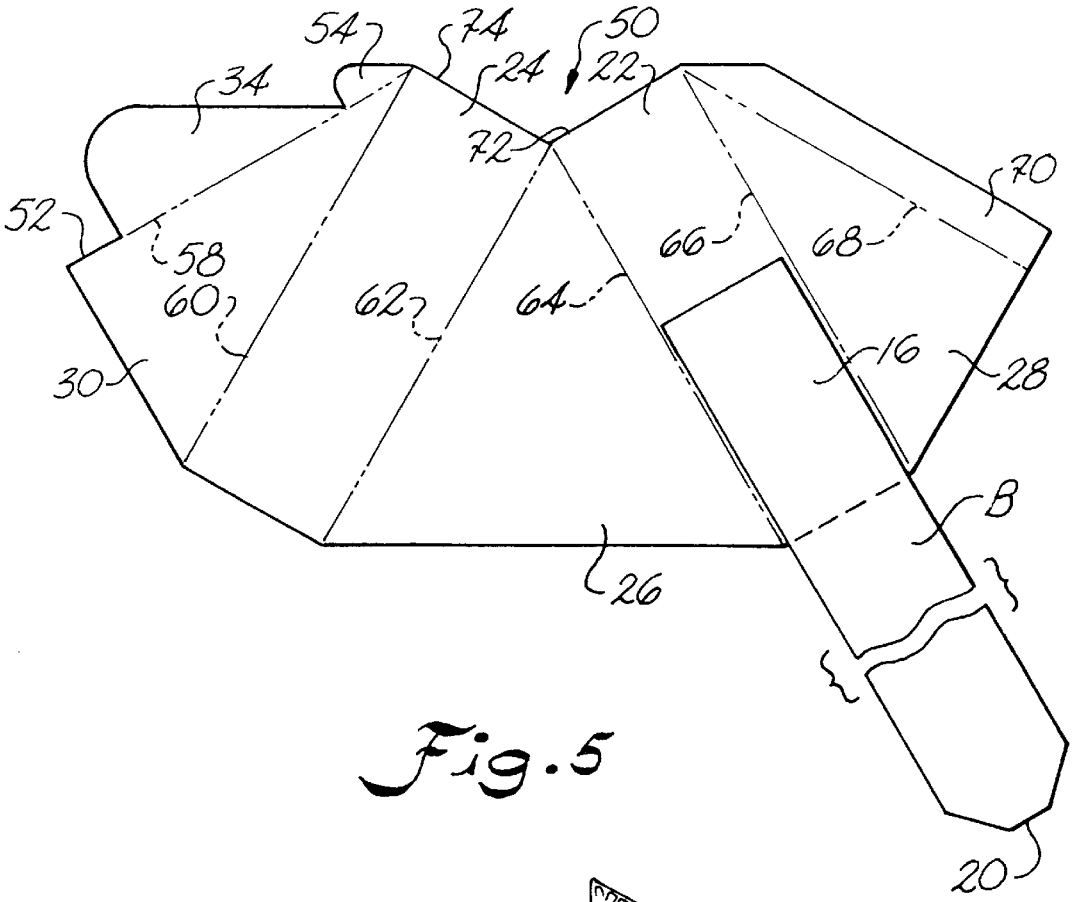
FIG. 5 is a plan view illustrating construction of an animal droppings collector constructed in accordance with the present invention, wherein the strap or band has been affixed to a sheet of material having folds which allow the material to be folded to form a container.

Turning to FIGS. 5 through 8, the construction of device 10 will now be discussed. FIG. 5 illustrates a sheet of material, generally, 50 having been cut into a predetermined configuration, as shown in FIG. 5. Projecting outwardly from one edge 52, is an upstanding tab 34, discussed above, and a fold over tab 54, used to help retain device 10 in a constructed state. Sheet 50 includes fold lines 58, 60, 62, 64, 66, and 68, which define side walls 22 and 24, bottom 26, top wall portions 28 and 30, and an adhesive tab 70.

Band B includes end 16 which is affixed to side 24, using adhesive, mechanical fasteners (not shown) or some other suitable fastening means. Edges 72 and 74 of side walls 22 and 24, respectively, form slot S, once container C is ultimately constructed, as shown in FIG. 8.

Figure 6:
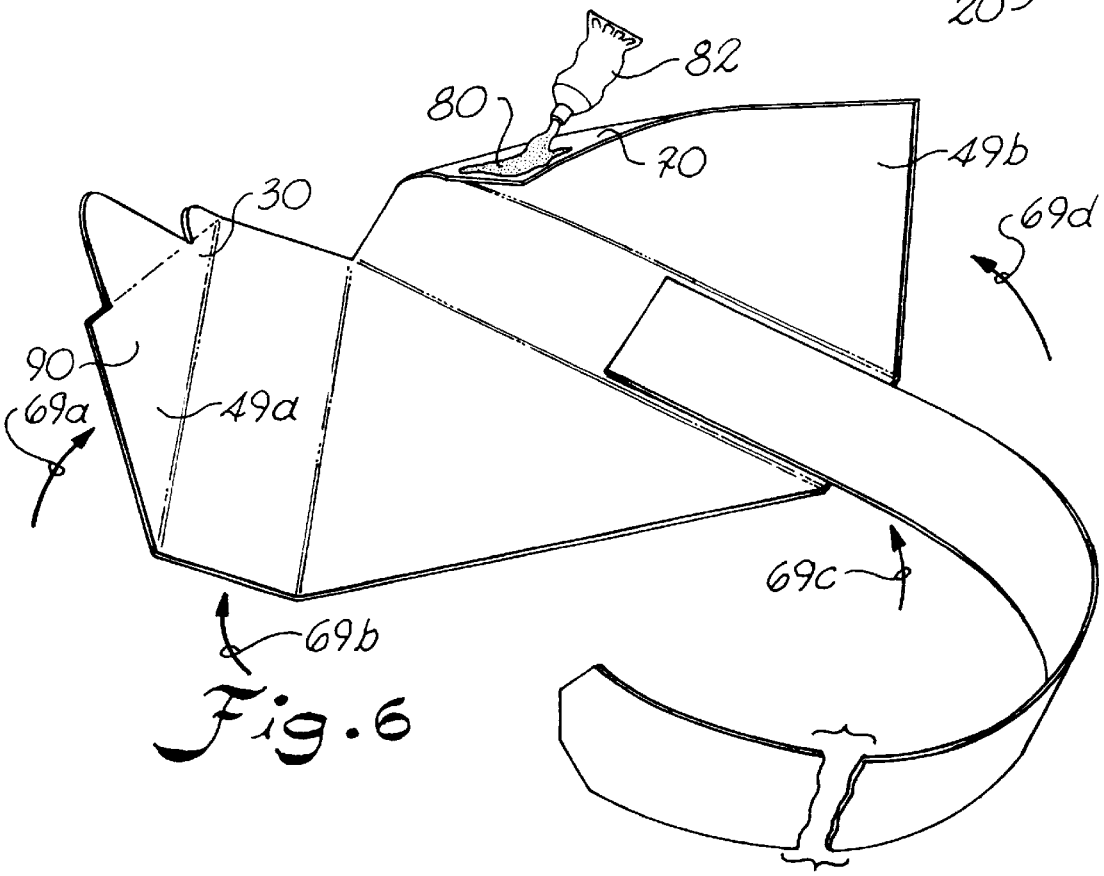
FIG. 6 is a perspective view illustrating adhesive being applied to a flat portion of the sheet of material.

FIG. 6 illustrates sheet 50 having been folded, at least partially, along fold lines 60, 62, 64, 66, and 68, in the directions of arrows 69*a*, 69*b*, 69*c*, and 69*d*. Shown schematically is the application of adhesive 80, using a tube of adhesive 82. Adhesive 80 is being applied to adhesive tab 70. It is to be understood that such adhesive 80 could be applied using automated means, and it is not limited to application tube 82, which is shown for illustration purposes only.

As shown in phantom in FIG. 7, adhesive tab 70 could be provided with a self-adhesive layer 83, having a disposal paper or plastic strip 84 which would be removed, in a conventional manner, in order to expose a line of adhesive.

FIG. 7 shows device 10 in a near complete state. Once folded in the direction of arrow 88, the underside 90 (FIG. 6) of top portion 30 will contact the upperside 92 of top portion 28 along adhesive 80 to fix top portions 28 and 30 together. Fold over tab 54 will also be folded over in the direction of arrow 94, and contacts adhesive on the upperside 92 of top portion 28 to affix fold over tab 54 to top portion 28. When top portions 30 and 28 are connected to one another with the adhesive, slot S remains open at the end, or in the triangular embodiment of container C disclosed, at the apex 98 thereof. Band B may then be inserted in slot S in the direction of arrow 99.

Free end 20 of band B includes beveled edges 100 which facilitate insertion of the free end 20 into slot S.

As shown in FIG. 8, free end 20 of band B has been inserted through slot S, to form loop L in band B. Upon pulling of free end 20 in the direction of arrow 102, loop L will shrink in size, as discussed above, to the point where eventually it will be contained entirely within compartment 18 of container C.

Multiple units of device 10 can be packaged by simply nesting containers C within compartments 18 thereof.

Alternately, devices 10 could be shipped flat, with use of self-adhesive strip, discussed above, and by the folding of band B. Once it became necessary to use device 10, the cover strip 84 of self-adhesive strip 83 could be removed, and the container C quickly assembled. Alternately, the user would buy devices 10 pre-assembled, or assemble them in advance, and carry device 10 in a pocket or purse, for example, when taking the animal, or dog, out for a walk, to play, for exercise, etc.

From the foregoing, it can be seen that the animal droppings collection device 10 of the present invention provides an effective tool for collecting animal droppings without requiring the user to touch the droppings, or to actually feel the contours thereof. Also, the scraping action of band B, as loop L is drawn into compartment 18, provides an effective cleanup of the droppings and collection into compartment 18. Once loop L has been drawn into compartment 18, the droppings are contained in compartment 18, and the entire device, droppings and all, can be carried by the user by simply holding the free end of the device, which spaces the droppings well away from the user's hand. Then, the entire device can be disposed of in a wastebasket, or other appropriate disposal location.

Another advantage of the present invention is the economical and lightweight construction of device 10, which should render it relatively inexpensive to produce and highly portable.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A device for picking up material, comprising:

a container defining a compartment having an opening;

a flexible elongated member having a first end and a free end, said first end being fixedly attached to said container; said elongated member being configured to form a loop adjacent to said opening of said compartment;

said loop being movable between a first position, for generally surrounding the material and a second position, wherein said loop is substantially inside of said compartment; and said loop being movable from said first position to said second position by pulling on said free end of said elongated member.

2. A device as defined in claim 1, wherein said elongated member is a flat strip.

3. A device as defined in claim 1, wherein said container is generally triangularly shaped.

4. A device as defined in claim 1, further comprising said container defining a slot for receiving said free end of said elongated member.

5. A device as defined in claim 1, further comprising said container defining a bottom side and a top side, and an upstanding tab provided on said top side of said container for facilitating holding of said container as said elongated member is pulled.

6. A device as defined in claim 1, wherein said container is generally triangularly shaped, and further comprising a slot for receiving said free end of said elongated member, said slot being adjacent the apex of said container.

7. A device as defined in claim 1, wherein said elongated member includes a bottom edge portion, said compartment includes a floor portion, and said bottom edge portion engages said floor portion as said loop is moved from said first position to said second position.

8. A device as defined in claim 1, wherein said elongated member defines a top edge portion and a bottom edge portion, said compartment defines a ceiling portion and a floor portion, and said top edge portion engages said ceiling portion as said loop moves between said first position and said second position.

9. A device as defined in claim 1, further comprising said container defining a slot in communication with said compartment for receiving said free end of said elongated member.

10. A device as defined in claim 1, wherein said elongated member is configured such that upon pulling of said free end, said loop decreases in size and moves towards said compartment.

11. A device for picking up animal droppings, comprising:

a container defining a compartment having an opening and a slot in communication with said compartment;

a flexible, elongated member, one end of said elongated member fixedly attached to said container, and the other end of said elongated member being a free end, said elongated member being configured to form a loop adjacent said opening of said compartment;

said elongated member free end configured such that upon pulling of said free end, said loop decreases in size and moves towards said compartment;

said loop being movable between a first position, for generally surrounding the animal droppings, wherein said loop is substantially outside of said compartment, and a second position, wherein said loop is substantially inside of said compartment generally surrounding the animal droppings; and said loop being movable from said first position to said second position by pulling on said free end of said elongated member.

12. A method of using a device for picking up material from a surface, comprising:

providing a container defining a compartment having an opening, said compartment being configured for receiving the material;

providing an elongated member having a first end connected to said container and a free end;

forming a loop in said elongated member adjacent said opening of said compartment;

placing said container adjacent the material, and substantially surrounding the material with said loop; and pulling on said elongated member such that said loop pulls the material into said compartment.

13. The method as defined in claim 12, further comprising holding said container generally stationary while performing said step of pulling on said elongated member.

14. The method as defined in claim 12, further comprising, suspending said container by said free end of said elongated member upon said loop and the material being in said compartment and disposing of said container.

15. The method as defined in claim 12, further comprising scraping the surface on which the material is held with said elongated member during said step of pulling on said elongated member.

16. The method as defined in claim 12, further comprising performing said step of pulling on said elongated member by pulling on said free end of said elongated member.

17. A method of using a device for picking up animal droppings, comprising:

providing a container defining a slot and a compartment having an opening, said compartment being configured for receiving the animal droppings;

providing an elongated member having a first end connected to said container and a free end;

forming a loop in said elongated member, and inserting said free end into said slot;

placing said container adjacent the animal droppings, and surrounding the animal droppings with said loop; and pulling on said elongated member such that said loop pulls the animal droppings into said compartment.

* * * * *